United States Patent [19]

Gross

[11] Patent Number: 4,909,383

[45] Date of Patent: Mar. 20, 1990

[54] HOLDER FOR LOTTERY PLAY SLIPS AND TICKETS

[76] Inventor: Wayne B. Gross, 2800 Cove Cay Dr., Apt. 3G, Clearwater, Fla. 34620

[21] Appl. No.: 383,945

[22] Filed: Jul. 21, 1989

[51] Int. Cl.[4] ..... A45G 11/18
[52] U.S. Cl. ..... 206/39
[58] Field of Search ..... 206/39–39.8

[56] References Cited

U.S. PATENT DOCUMENTS 4,741,372 5/1988 Santilli ..... 206/39 X

FOREIGN PATENT DOCUMENTS 872654 2/1942 France ..... 206/39
83662 3/1954 Norway ..... 206/39

*Primary Examiner*—William Price
*Attorney, Agent, or Firm*—Joseph C. Mason; Ronald E. Smith

[57] ABSTRACT

A lottery ticket holder having two compartments. The first compartment holds an elongate flat lottery slip and is closed by a first flexible flap. The second compartment holds a truncate flat lottery ticket and is closed by a second flexible flap. The holder is formed of transparent material and has advertising indicia and instructions concerning the use of the holder printed thereon.

10 Claims, 3 Drawing Sheets

HOLDER FOR LOTTERY PLAY SLIPS AND TICKETS

TECHNICAL FIELD

This invention relates, generally, to containers for flat articles. More particularly, it relates to a container having dual compartments for the storage of lottery paraphernalia.

BACKGROUND ART

Many states have responded to budget crises by creating state lotterys; citizens voluntarily participate in various state-sponsored lottery games and the state government retains some of the proceeds to enhance the state treasury.

Many lottery games require the lottery player to feed a play slip into a scanner means; the scanner reads the player-selected numbers, prints a lottery ticket bearing the numbers selected by the player for the player to keep as a receipt, and returns the play slip to the player.

It takes time to fill out the play slips, so many people submit the same play slips every time they play the lottery game. The play slips, since they must be fed into a scanning machine, must remain in a substantially pristine condition, even after multiple uses. The scanner will reject a play slip that has tattered corners, for example, and such rejection necessitates another time-consuming completion of a play slip.

Perhaps more importantly, the lottery ticket/receipt generated by the scanner's printer must be retained by the player until the winning numbers of the lottery are announced. The prize cannot be claimed in the absence of the ticket.

Some players keep their play slips and tickets in purses, but such storage eventually results in tattered play slips and lost tickets. Billfolds will hold the tickets, but will not hold the play slips without folding them.

Over the years, inventors have developed a number of holders for lottery paraphernalia and flat articles in general.

For example, U.S. Pat. Nos. 4,721,309 and 4,781,379 to Miesel and French Pat. Nos. 2,575,077 and 2,483,243 disclose plastic envelopes having pockets for lottery wagering paraphernalia. The envelopes have pockets that include closure flaps and indicia on the outside of the pockets.

Clear plastic envelopes having pockets with flaps for keeping the contents of the pockets from falling out are also shown in U.S. Pat. Nos. 2,358,983 to Lyndes et. al., and 3,884,412 to Price. Similar items are shown in U.S. Pat. Nos. 4,234,086 to Dorton, 4,713,136 to Felipe, and 4,726,970 to Morrish.

Flaps that may be quickly inserted into holding straps are shown in U.S. Pat. Nos. 1,688,699 to Garner, Jr., 1,589,118 to Cowen, 2,346,571 to Ginsberg and 1,370,636 to Dwyer, and German Pat. No. 384,257.

Devices which show slots or slits instead of holding straps appear in U.S. Pat. Nos. 3,944,132 to Caprile and 2,087,825 to Vaughn.

DISCLOSURE OF INVENTION

The present invention is a substantially flat holder of lottery paraphernalia. It has two pockets, both of which are closed by flexible flap members to insure that the articles in the pockets are not lost.

The first pocket holds at least one flat, elongate playing slip and the second pocket holds at least one lottery ticket. The size of the second pocket is sufficient to retain cards about the size of a business card because most lottery tickets are substantially the same size as a common business card.

In an alternative embodiment, the second pocket is expandable to hold a large plurality of lottery tickets, because multiple lottery tickets can be generated from a single playing slip.

It is an important object of this invention to provide an economical holder for lottery play slips, tickets and the like.

The invention accordingly comprises the features of construction, combination of elements and arrangement of parts that will be exemplified in the description set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT THE INVENTION

Figure 1:
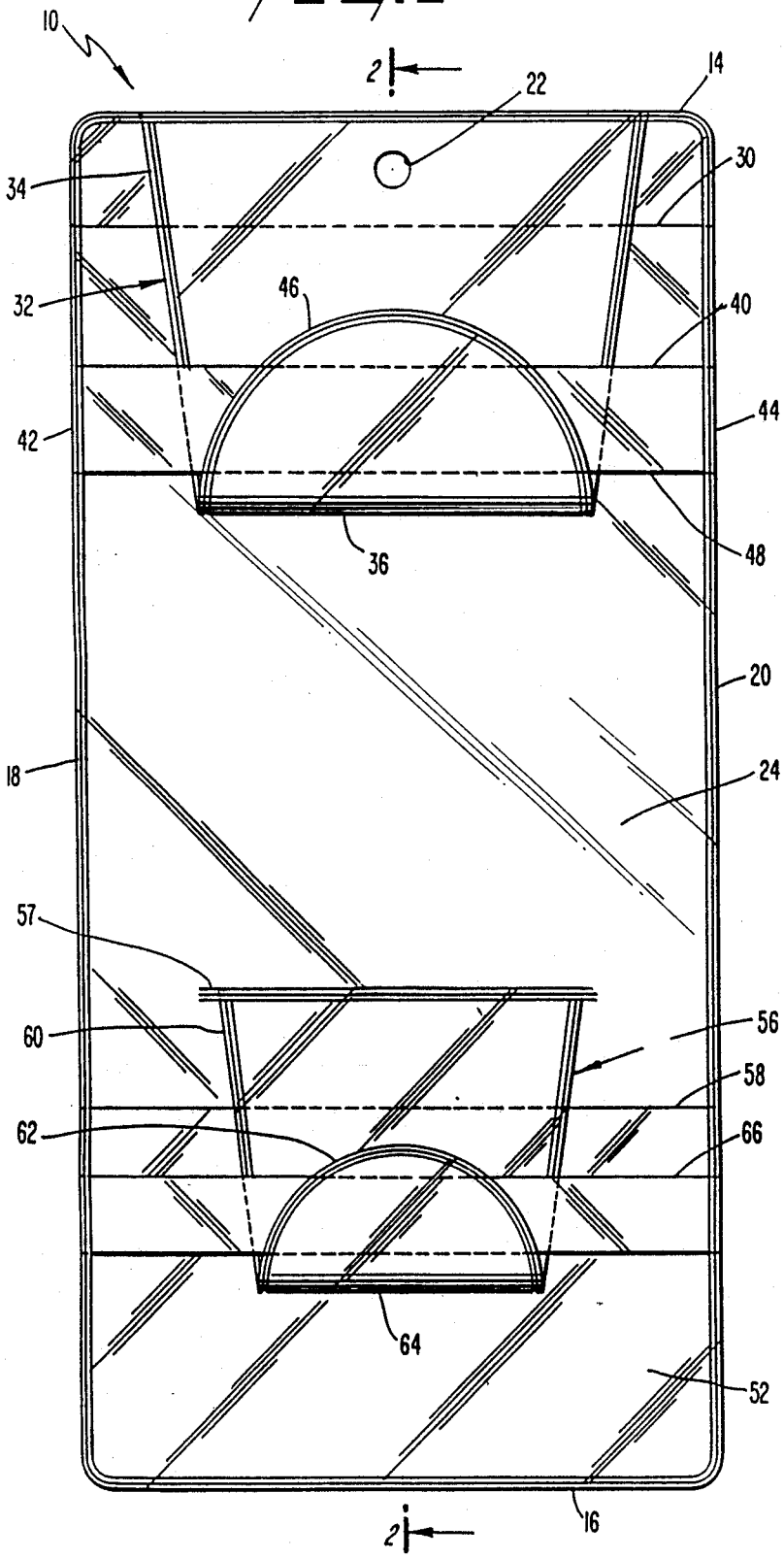
FIG. 1 is a front elevational view of a first embodiment of the invention.
Figure 2:
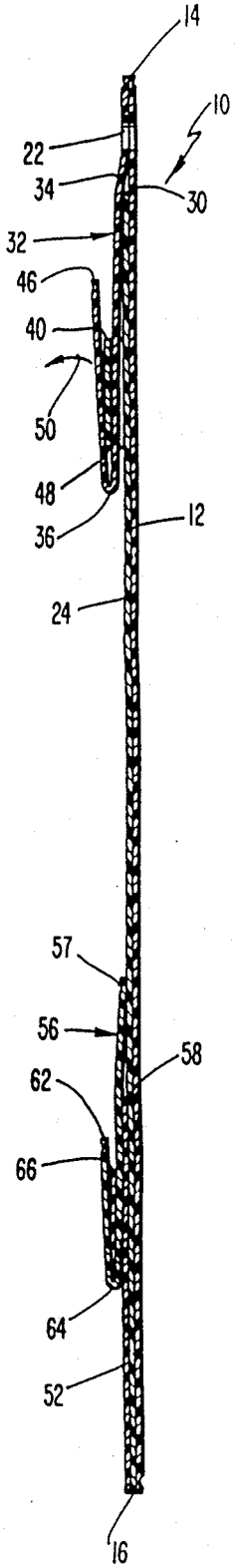
FIG. 2 is a sectional view taken along line 2—2 in FIG. 1.

Referring now to FIGS. 1 and 2, it will there be seen that an embodiment of the present invention that illustrates the teachings and suggestions hereof is denoted by the reference numeral 10 as a whole.

Holder 10 is preferably of rectangular configuration as shown. It includes a rectangular back wall or flexible sheet 12 having a width at least as wide as a common business card or lottery ticket, and a length greater than the length of a lottery playing slip.

Back wall 12 has a top edge 14, a bottom edge 16, and side edges 18, 20.

An aperture means or peg hole 22 is formed in back wall 12 just below top edge 14, mid-width of said top edge. Holder 10 is displayed for sale by axially inserting a peg through peg hole 22 in the well known manner. The purchaser of holder 10 may store it at home on a similar peg or by attaching it to a bulletin board with a push pin or thumb tack.

A middle wall or second flexible sheet 24 having top edge 30 overlies back wall 12; its width is the same as the width of the back wall, but its longitudinal extent is less than that of the back wall. The side and bottom edges of middle wall 24 are coincident with the side and bottom edges of back wall 12 as shown, and are secured thereto by suitable means such as heat sealing.

A top edge of a lottery ticket would extend beyond top edge 30 of middle wall 24 but would not extend beyond top edge 14 of back wall 12. Accordingly, a lottery play slip is slidably retained in sandwiched disposition in a first elongate first cavity means defined between back wall 12 and middle wall 24.

The upper part of flexible flap member 32 is heat sealed to back wall 12 above top edge 30 of middle wall 24, as indicated by the reference numeral 34. Peg hole 22 extends through that part of flap 32 that is heat sealed to back wall 12. Flap 32 is reversely folded along fold line 36 as shown.

A transversely disposed holding strap 40 is fixedly secured to the side edges of middle wall 24 at its opposite ends 42, 44. Strap 40 is positioned below top edge 30 of middle wall 24. The lottery play slip is secured by passing flap 32 under holding strap 40 until the arcuate bottom edge 46 of the folded flap 32 has cleared the bottom edge 48 of holding strap 40; the free end of flap 32 is then displaced in the direction of directional arrow 50 and arcuate end 46 is brought upwardly until bottom edge 48 of holding strap 40 substantially abuts fold line 36 of flap 32, i.e., until holding strap 40 is disposed in sandwiched relation between the folded parts of flap 32.

The reverse fold of flap 32 insures that play slip 26 will not be lost.

A second pocket or cavity means is formed by front wall or top sheet 52 and middle wall 24. The longitudinal extent of front wall 52 is truncated; the side and bottom edges of front wall 52 overlie and are in registration with the side and bottom edges of middle wall 24.

The longitudinal extent of front wall 52 is sufficient to completely cover a lottery ticket (about the size of a business card) when inserted into the second pocket. The second pocket defined by front wall 52 and middle wall 24 is closed by a closure means having the same construction as the closure means that closes the lottery playing slip compartment.

More specifically, flap 56 is heat sealed as at 57 to middle wall 24 above top edge 58 of front wall 52; flap 56 has a proximal end 60, an arcuate distal end 62 and a reverse fold line 64 therebetween. It is secured to holding strap 66 in the same manner as flap 32 is secured to holding strap 40.

Figure 3:
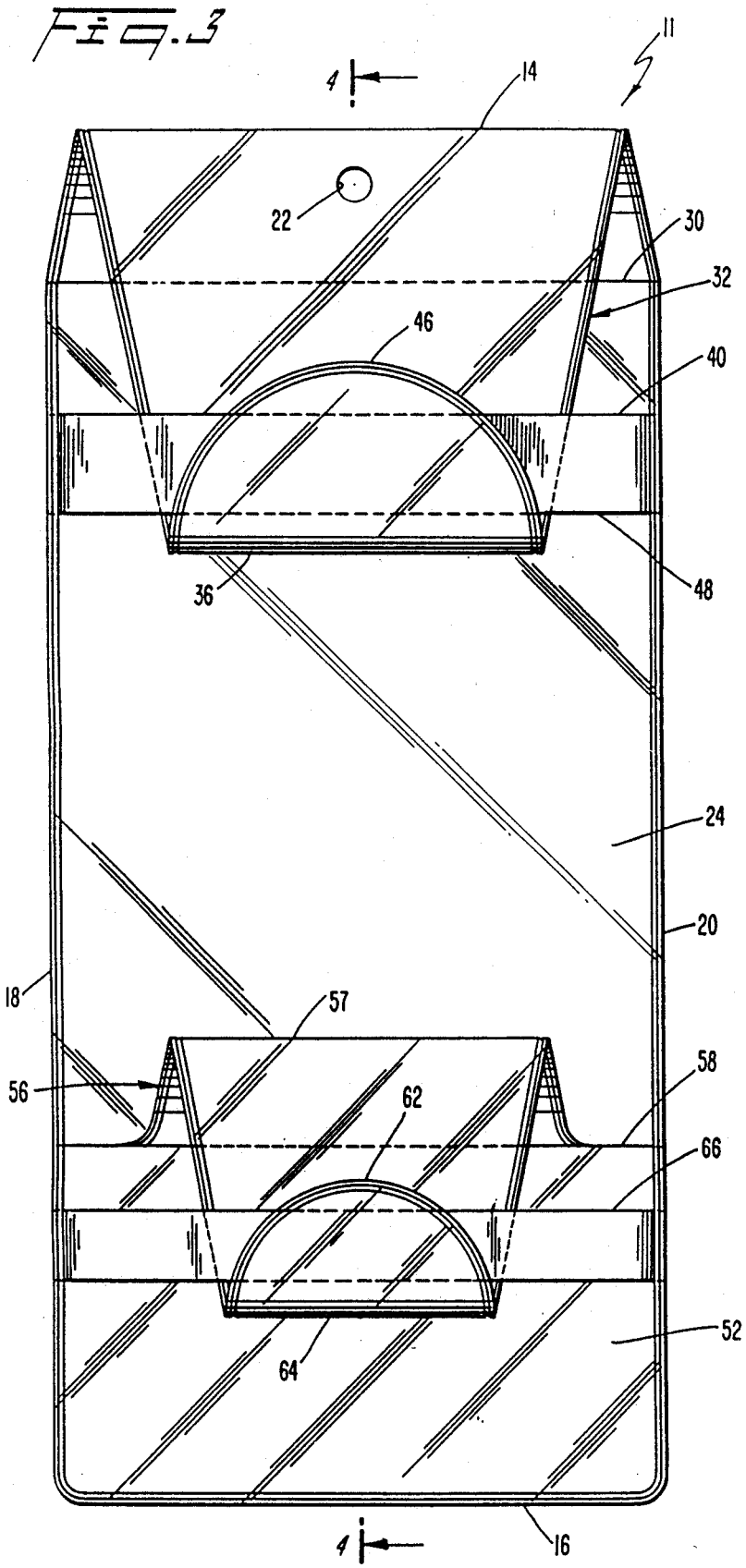
FIG. 3 is a front elevational view of a second embodiment of the invention.
Figure 4:
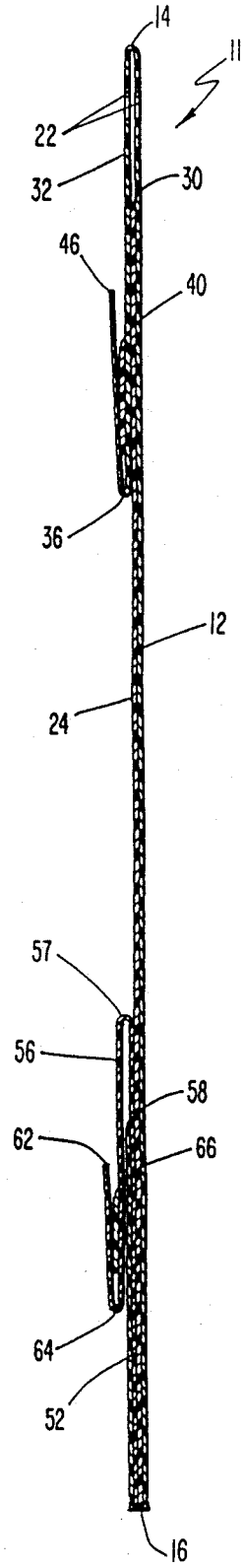
FIG. 4 is a sectional view taken along line 4—4 in FIG. 3.

FIGS. 3 and 4 show an alternative embodiment 11 where heat sealing is not employed to attach flap 32. In this embodiment, flap 32 is integral with top edge 14 of back wall 12 as shown. Flap 56, having reversely folded top edge 57, is integral or heat sealed to middle wall 24. In all other respects, this second embodiment is the same as the embodiment of FIGS. 1 and 2.

Figure 5:
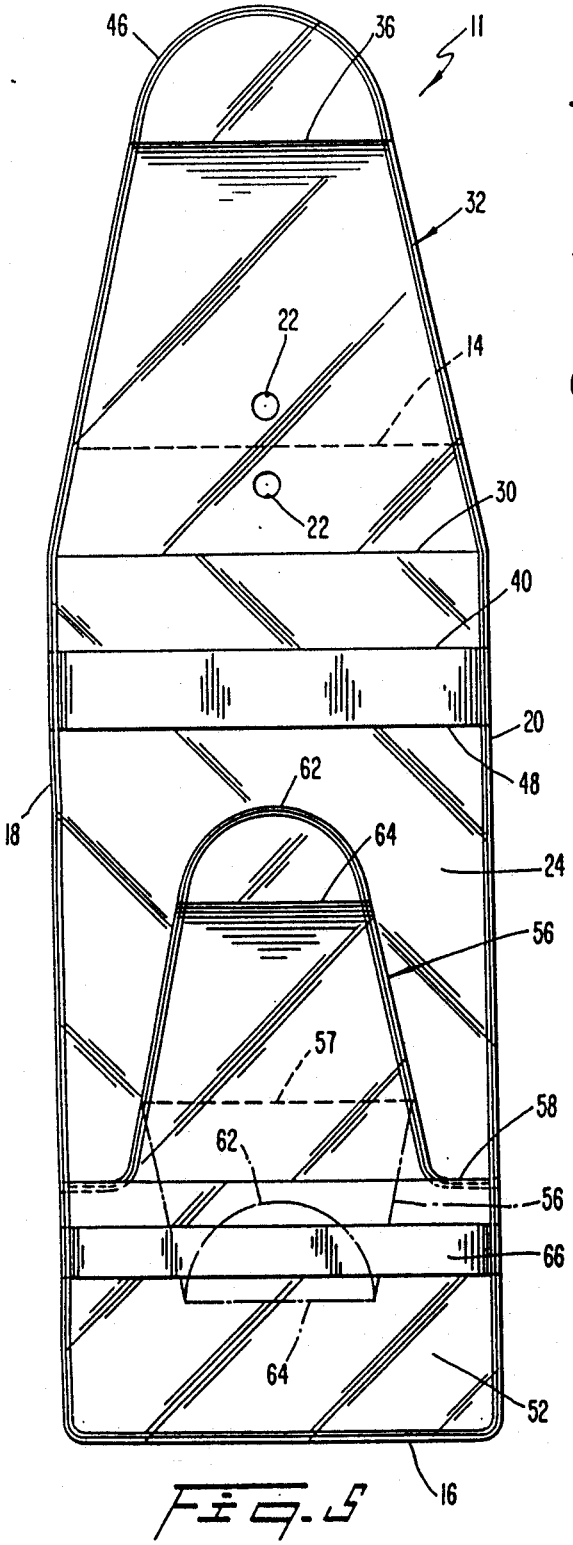
FIG. 5 is a front elevational view of the embodiment of FIG. 3 showing both flaps in their unfolded configuration.

FIG. 5 shows the embodiment of FIGS. 3 and 4 in its "flaps open" configuration.

Figure 6:
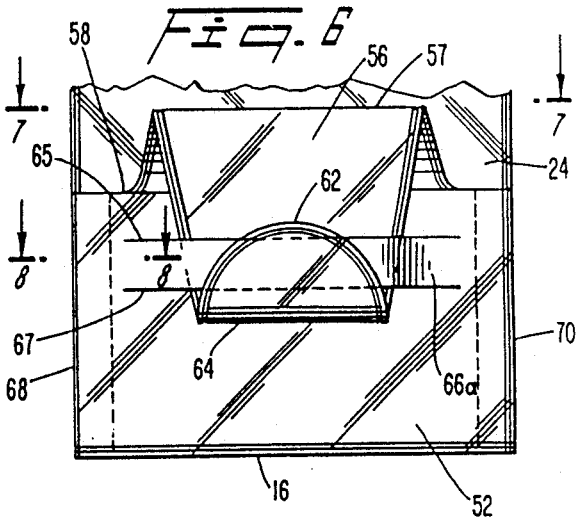
FIG. 6 is a partial front elevational view of a third embodiment of this invention.
Figure 7:
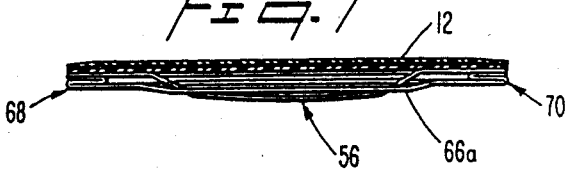
FIG. 7 is a sectional view taken along line 7—7 in FIG. 6.
Figure 8:
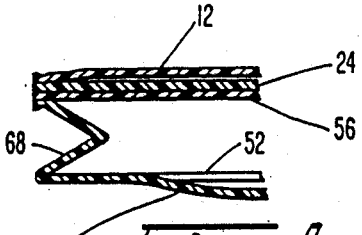
FIG. 8 is an enlarged sectional view taken along line 8—8 in FIG. 6.

Referring now to FIGS. 6–8, it will there be noted that front wall 52 is secured to middle wall 24 along its edges as in the first-described embodiment, but that accordion edge walls 68, 70 have been added. In this manner, the pocket for the lottery ticket is expandable, i.e., a large plurality of lottery tickets can be conveniently stored, as perhaps best understood in connection with FIG. 8.

It should also be observed in this embodiment that holding strap member **66*a* is not heat sealed to edges 18, 20 as in the earlier described embodiments. Instead, it is cut out of front wall 52 as best shown in FIG. 8. Specifically, a pair of transversely disposed, parallel slits 65, 67 (FIG. 9) are formed in front wall 52 to form holding strap member 66*a*. If the opposite ends of member 66*a* were heat sealed to edges 18–20, such structure would prevent the expansion of the pocket member that holds the lottery ticket receipts, i.e. front wall 52 could not separate from middle wall 24** to accommodate a plurality of lottery tickets.

Figure 9:
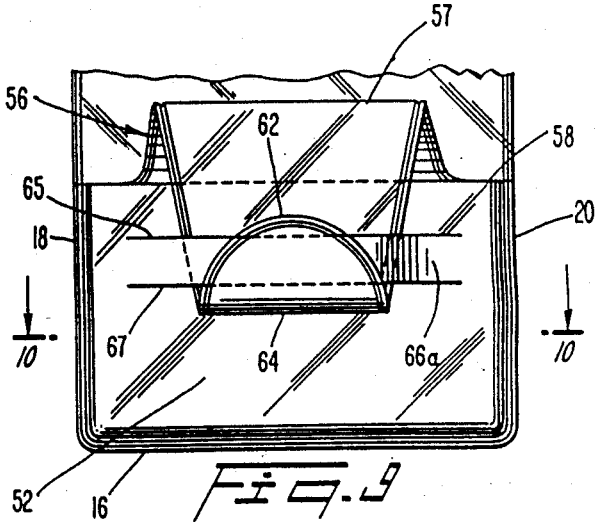
FIG. 9 is a partial front elevational view of a fourth embodiment of the invention.
Figure 10:
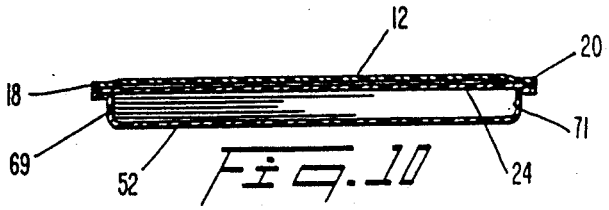
FIG. 10 is a sectional view taken along line 10—10 in FIG. 9.

A blister type pocket member for holding a plurality of lottery tickets is shown in FIGS. 9 and 10. This eliminates the need for the expandable walls 68, 70 since the pocket is permanently in its FIG. 10 position, i.e., sidewalls 69, 71 are substantially rigid.

Although the novel holder may be formed of many different types of materials, it is preferable to form it of a heat resistant plastic material. Moreover, the holder 10 is preferably transparent.

Indicia means instructing the owner of the holder as to its use may also be provided. Advertising indicia containing an advertisement of the establishment selling the novel holder, may also be provided, as shown in FIGS. 1 and 3.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A container for flat articles, comprising:

a flat back wall of rectangular configuration;

said back wall having a predetermined width and a predetermined length;

a flat middle wall of rectangular configuration;

said middle wall having a width equal to the width of said back wall and having a predetermined length only slightly less than the length of said back wall;

a flat front wall of rectangular configuration;

said front wall having a width equal to the respective common widths of said back and middle walls and having a predetermined length substantially less than the length of said middle wall;

said middle wall disposed in overlying relation to said back wall;

said back wall and said middle wall being sealed to one another along their respective side and bottom edges;

said front wall being disposed in overlying relation to said middle wall;

said middle wall and said front wall being sealed to one another along their respective side and bottom edges;

an elongate cavity means being formed between said back wall and said middle wall;

a truncate cavity means formed between said middle wall and said front wall;

a first transversely disposed holding strap member disposed in overlying relation to said middle wall;

said first holding strap member having its opposite ends secured to opposite side edges of said middle wall;

a first flexible flap member secured to said back wall below a top edge thereof and above a top edge of said middle wall;

a second transversely disposed holding strap member disposed in overlying relation to said front wall;

said second holding strap member having its opposite ends secured to opposite side edges of said front wall; and a second flexible flap member secured to said middle wall below a top edge of said middle wall and above a top edge of said front wall;

whereby an elongate flat item is positioned in said first cavity means and secured therein when said first flap member is closed and secured under said first holding strap member; and whereby a truncate flat item is positioned in said second cavity means and secured therein when said second flap member is folded and secured under said second holding strap member.

2. The container of claim 1, further comprising means for expanding said truncate cavity means.

3. The container of claim 2, wherein said means for expanding said truncate cavity means includes accordian side walls disposed at transversely spaced ends of said truncate cavity means.

4. The container of claim 3, wherein said second holding strap member is formed by a pair of parallel slits formed in said front wall so that said front wall is free to expand.

5. The container of claim 2, wherein said front wall is provided in the form of a blister means, said blister means forming a pocket member for the retention of a plurality of flat articles.

6. A combination lottery play slip and ticket holder, comprising:

a back wall having a longitudinal extent greater than the longitudinal extent of a lottery play slip and a width greater than the width of a lottery play slip;

a first flexible flap member integral to a top end of said back wall;

a middle wall having a longitudinal extent less than the longitudinal extent of a lottery play slip and a width greater than the width of a lottery play slip, said middle wall being disposed in overlying relation to said back wall;

a flat, elongate cavity means being formed between said back and middle walls;

a front wall having a longitudinal extent greater than the longitudinal extent of a lottery ticket and having a width greater than the width of a lottery ticket;

a flat, truncate cavity means being formed between said middle and front walls;

a second flexible flap member integral to said middle wall;

a first holding strap member being transversely disposed in overlying relation to said middle wall, downwardly of a top edge thereof;

a second holding strap member being transversely disposed in overlying relation to said front wall, downwardly of a top edge thereof; and said first and second flap members being reversely folded near their respective free ends so that a medial part of each flap underlies its associated holding strap member and so that a free end thereof overlies its associated holding strap member.

7. The holder of claim 6, further comprising means for expanding said truncate cavity means.

8. The holder of claim 7, wherein said means for expanding said truncate cavity means includes accordian side walls disposed at transversely spaced ends of said truncate cavity means.

9. The holder of claim 7, wherein said front wall is provided in the form of a blister means, said blister means forming a pocket for the retention of a plurality of lottery tickets.

10. A holder for flat articles, comprising:

a first flexible sheet of transparent, heat resistent plastic material;

said first sheet of material having a predetermined width and length;.

a second flexible sheet of transparent, heat resistent plastic material;

said second sheet of material having a width equal to the width of said first sheet of material;

said second sheet of material having a length less than the length of said first sheet of material;

said second sheet of material disposed in overlying relation to said first sheet of material and being disposed in registration therewith such that the side and bottom edges of said second sheet of material overlie the side and bottom edges of said first sheet of material;

said side and bottom edges of said second sheet of material being fixedly secured to the corresponding side and bottom edges of said first sheet of material;

a first open ended flat cavity means being formed between said first and second sheets of material so that an elongate flat article is slidably receivable therein;

a closure means for selectively closing said first cavity means;

said closure means having a base part fixedly secured to said first sheet of material between a top edge thereof and a top edge of said second sheet of material;

a first transversely disposed holding strap member disposed in overlying relation to said second sheet of material and being positioned below said top edge of said second sheet of material and having its opposite ends fixedly secured to opposite side edges of said second sheet of material;

said closure means having a flexible flap part integral with said base part, said flap part being slidable under said first holding strap member and being attachable thereto to securely close said first cavity means;

a third sheet of transparent, heat-resistent plastic material;

said third sheet of material having a width equal to the common width of said first and second sheets of material;

said third sheet of material having a length substantially less than the length of said second sheet of material;

said third sheet of material disposed in overlying relation to said second sheet of material and being disposed in registration therewith such that the side and bottom edges of said third sheet of material overlie the side and bottom edges of said second sheet of material;

said side and bottom edges of said third sheet of material being fixedly secured to the corresponding side and bottom edges of said second sheet of material;

a second open-ended flat cavity means being formed between said second and third sheets of material so that a truncate flat article is slidably receivable therein;

a closure means for selectively closing said second cavity means;

said closure means having a base part fixedly secured to said second sheet of material between a top edge thereof and a top edge of said third sheet of material;

a second transversely disposed holding strap member disposed in overlying relation to said third sheet of material and being positioned below said top edge of said third sheet of material and having its opposite ends fixedly secured to opposite side edges of said third sheet of material; and said closure means having a flexible flap part integral with said base part, said flap part being slidable under said second holding strap member and being attachable thereto to securely close said second cavity means.

* * * * *